US005845336A

United States Patent [19]

Golde

[11] Patent Number: 5,845,336

[45] Date of Patent: Dec. 8, 1998

[54] VERSATILE ALL-WEATHER VENTILATED AND PROTECTIVE GARMENT

[75] Inventor: Paul J. Golde, Mission Viejo, Calif.

[73] Assignee: Intersport Fashions West

[21] Appl. No.: 865,388

[22] Filed: May 29, 1997

[51] Int. Cl.[6] ..... A41D 13/00

[52] U.S. Cl. ..... 2/93; 2/108; 2/94

[58] Field of Search ..... 2/69, 69.5, 85, 2/87, 93, 94, 79, 108, 272, DIG. 1, 102, 115, 104, 105, 106

[56] References Cited

U.S. PATENT DOCUMENTS

| | | |
|---|---|---|
| 2,700,769 | 2/1955 | Polchinski . |
| 2,713,168 | 7/1955 | Bagnato . |
| 3,045,243 | 7/1962 | Lash et al. . |
| 3,086,215 | 4/1963 | Paola . |
| 3,153,793 | 10/1964 | Lepore . |
| 4,513,451 | 4/1985 | Brown . |
| 4,608,715 | 9/1986 | Miller et al. . |
| 4,665,563 | 5/1987 | Harvey . |
| 4,722,099 | 2/1988 | Kratz . |
| 4,969,214 | 11/1990 | Cohen . |
| 5,105,477 | 4/1992 | Golde . |
| 5,115,516 | 5/1992 | Golde . |
| 5,507,042 | 4/1996 | van der Slessen . |

FOREIGN PATENT DOCUMENTS

| | | |
|---|---|---|
| 3818566 | 7/1989 | Germany . |

*Primary Examiner*—Gloria Hale
*Attorney, Agent, or Firm*—Terry L. Miller

[57] ABSTRACT

A versatile weather-resistant, ventilated, and protective garment particularly for wear by operators, occupants, and passengers of motor-sports vehicles, such as motorcycles, other vehicles, and some open aircraft, includes a waterproof garment shell provided with a vent opening. The vent opening may be secured open or closed in a fair-weather configuration. for foul weather, the vent opening also includes a labyrinth seal structure in combination with a generally vertically-extending water-gutter structure so that wind-blown rain water and traffic mist, for example, will be blocked from entry into the garment. Water which does enter an outer portion of the vent openings, will be drained by the water-gutter structure. The garment also includes a cargo storage system having a storage area with plural pockets allowing the wearer to carry along small personal items in the garment. An opening of the ventilation structure also provides access to the cargo storage area. This cargo storage system is provided with a linearly continuous closure separating the storage area form the opening of the ventilation structure.

18 Claims, 3 Drawing Sheets

FIG. 1.
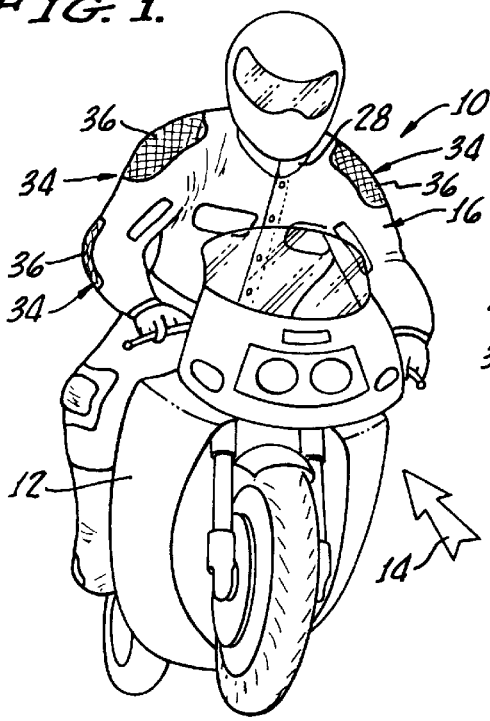
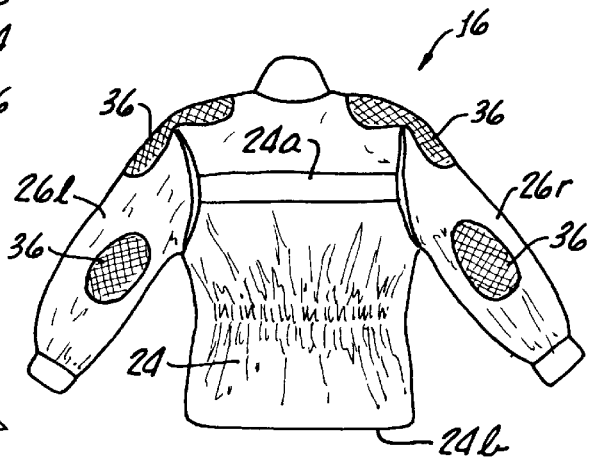
FIG. 2a.
FIG. 2.
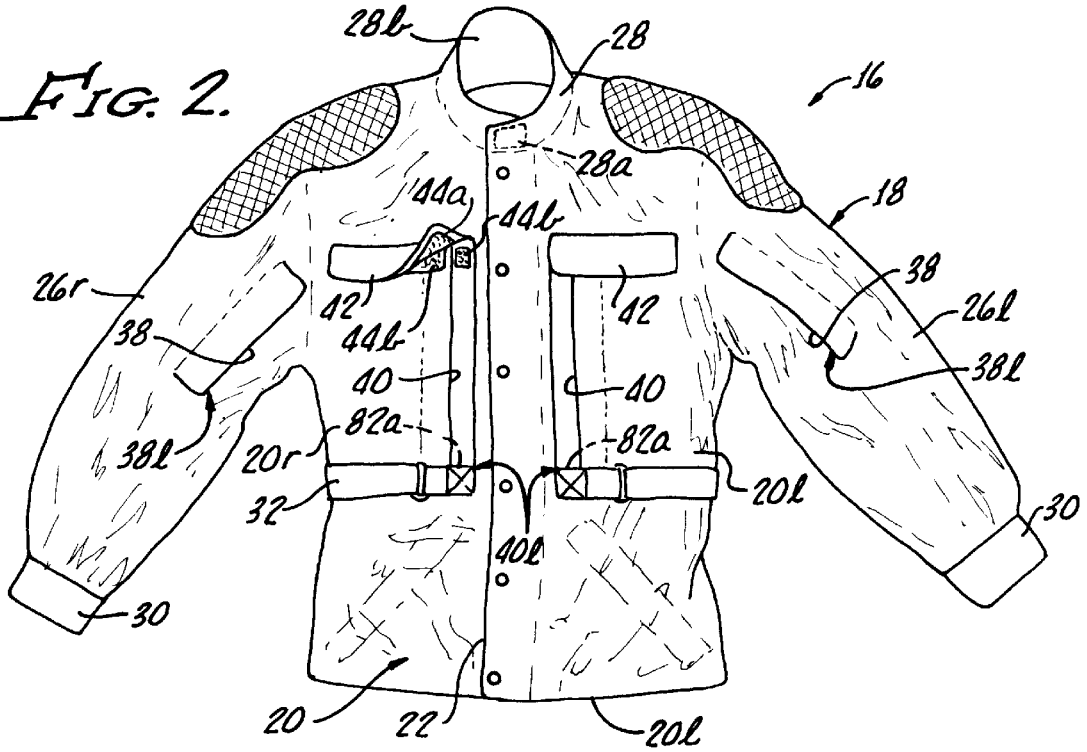

FIG. 3.
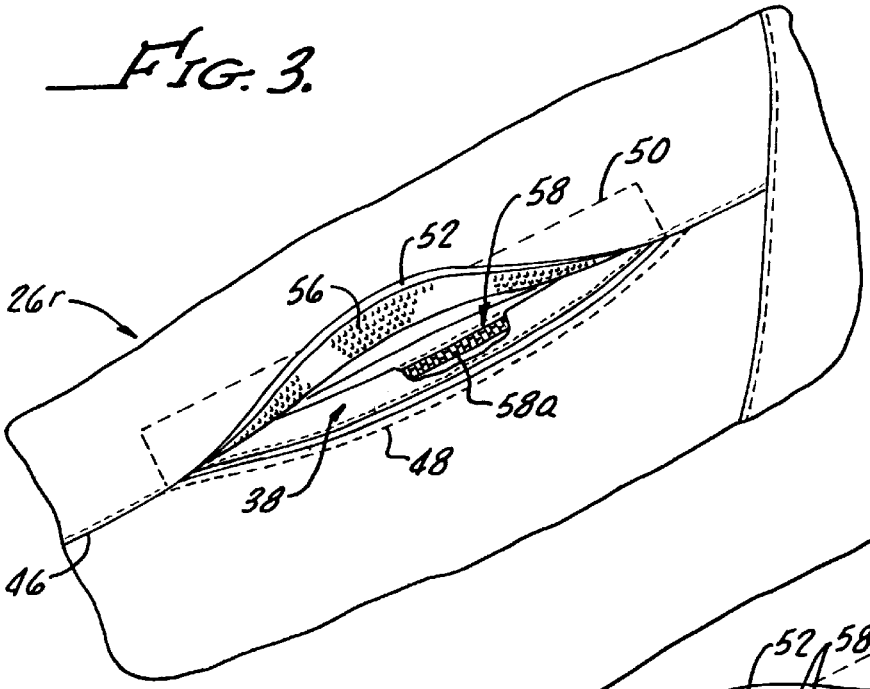
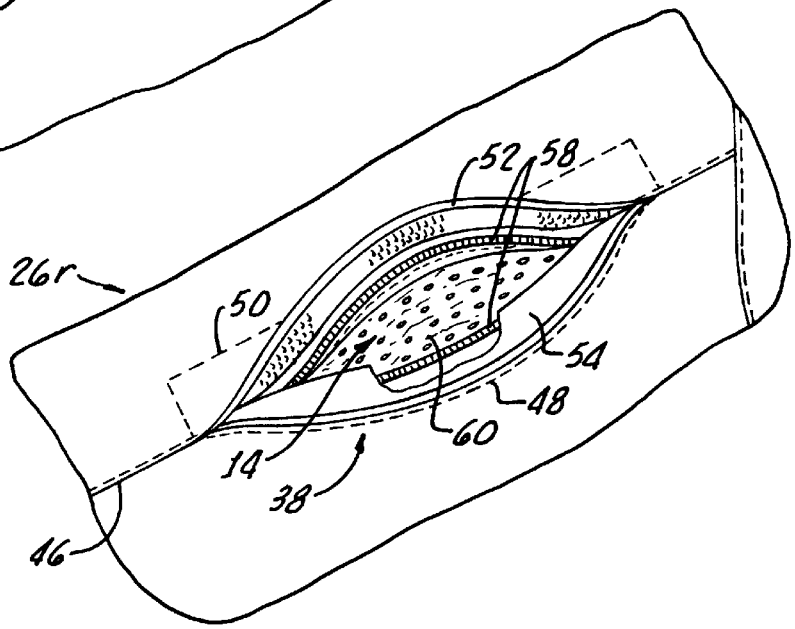
FIG. 4.
FIG. 5.
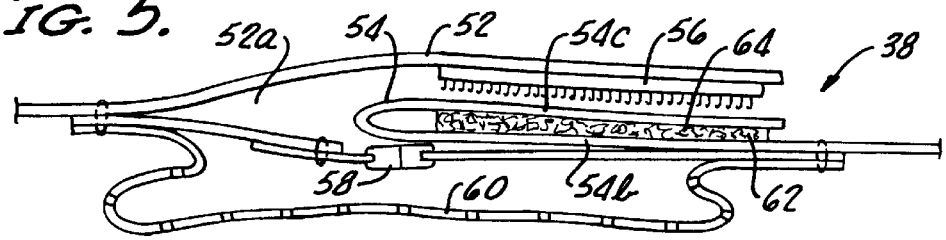
FIG. 6.
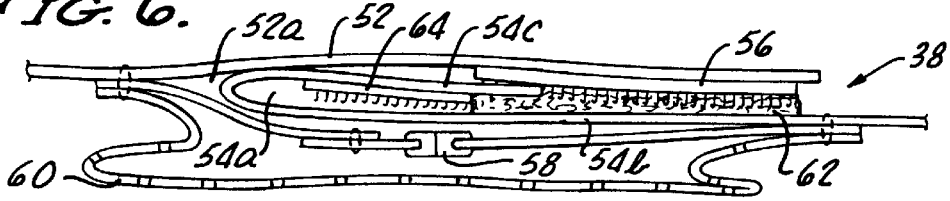

VERSATILE ALL-WEATHER VENTILATED AND PROTECTIVE GARMENT

BACKGROUND OF THE INVENTION

1. Field of the Invention

The present invention relates to a protective, ventilated, and weather-resistant garment in the form of a jacket or coat. The garment is especially configured and structured for wear by sports participants who are subjected to the elements, need physical protection for their person, may need to carry a variety of personal items with them in the garment, and also desire an adequate ventilation air flow during warm-weather and hot-weather conditions. Such persons may include operators or occupants of sports motor vehicles, for example, of motorcycles, snowmobiles, boats, bicycles, and some open aircraft. Preferably, the garment includes an outer shell made primarily of breathable water-proof material (i.e., of Gortex, for example). The garment is especially designed and constructed to keep the wearer protected during foul-weather, as well as providing adequate ventilation during fair-weather and hot-weather wear. Additionally, in the event of a mishap, the garment provides important physical protection to the wearer.

2. Related Technology

Operators of motorcycles and other sports motor vehicles have for years sought to protect themselves from injury in the event of a mishap. Competition motorcycle riders have commonly worn full "leathers", which are a full cover-all type of leather suit, many having built in panels of protective body armor. For warm-weather wear, such "leathers" made in part from perforated leather panels have been available. These "leathers", are generally not practical for wear by the street motorcycle rider. For example, these leather suits, whether made of un-perforated or perforated leather, provide virtually no protection against rain.

Nevertheless, street motorcycle riders have favored various leather jackets and coats because of the abrasion resistance provided by the leather in the event of a spill from the moving motorcycle. Many of these jackets traditionally do not have any form of body armor for the rider. Some have no particular provision for ventilation to the rider in warm and hot weather. Particularly in hot weather leather can be uncomfortably warm to wear. However, even in hot weather some motorcycle riders endure the discomfort of a leather jacket, not because it is needed for protection from the elements, but because of concerns for personal safety and survival in the event of a spill from the motorcycle at any speed. On the other hand, in hot weather some cavalier motorcycle riders partially or fully open the front zipper or snaps of their jacket in order to allow the moving air stream to rush in.

However, this expedient is very unsafe because it allows the jacket to billow or whip in the air stream, possibly compromising the rider's ability to control the vehicle, and certainly contributing to rider fatigue after a period of being subjected the whipping leather jacket. Fatigue and the resulting decrease in the rider's situational awareness may be a contributing factor in many motorcycle accidents. Importantly, in the event of a spill, an open jacket or coat is more likely to slide up the wearer's torso, and provide little or no protection against abrasion.

Consequently, leather jackets and coats with provisions for ventilation while closed and still providing adequate protection to the wearer have been developed. Examples of leather coats and jackets which are conventional are seen in U.S. Pat. No. 4,608,715, issued Sep. 2, 1986 to Richard Miller and John Wyckoff; in U.S. Pat. No. 5,105,715, issued Apr. 21, 1992 to Paul Golde, and in U.S. Pat. No. 5,507,042, issued Apr. 16, 1996 to Michael van der Slessen. German patent publication No. DE 3818-566-A1 published Dec. 7, 1989, provides another example of this conventional approach to providing protection and ventilation to riders of motorcycles.

However, leather has a significant shortcoming in use for protection to motorcycle riders and other such sport vehicle operators and occupants. This shortcoming was alluded to above with respect to the leather suits generally worn by competition motorcycle riders. That is, leather is not of itself very good at protecting the wearer from the elements. In the event the wearer encounters a rain storm while riding a motorcycle or open aircraft, for example, or encounters wet snow or water spray in the event of a snowmobile or boat operator or occupant, then the leather jacket or coat will quickly soak up enough water to become sodden and heavy, and will let water reach the wearer. Some very slight and generally temporary increase in the water resistance of leather garments can be achieved by treating them with a water repellant, such as ScotchGuard, for example. However, this expedient is really not very long lasting and is not satisfactory. Consequently, motorcycle riders and other sport vehicle operators have had to carry a rain suit with them for use in foul-weather conditions.

A rain suit worn over a leather jacket does provide adequate foul-weather protection (i.e., it protects the rider against rain and vehicle water spray), and the rider still has the abrasion resistance provided by the leather jacket, but ventilation is completely cut off. Consequently, after the rain passes unless the rider stops to take off the rain suit, he finds himself in a virtual sauna of humidity trapped inside the rain suit with almost no ventilation. Further, if the wearer is traveling on a day with intermittent rain, the inconvenience of stopping to put on the rain suit when rain is encountered and stopping again to take it off again after the rain passes is very frustrating and time consuming.

Some sport vehicle rain suits made of Gortex and similar fabrics which are water-proof but breathable have been available for some time. Some of these suits are simply snowmobile suits put to this purpose. These snowmobile suits tend to have much more insulation than is desirable for many conditions of motorcycle riding. Other such fabric rain suits are made especially for motorcycle riders, and have less insulation. In general, all of these suits are worn over street clothes, and although some may have protective features such as body armor sections, none are known to provide ventilation for warm-weather wear.

Some garments have been developed which provide both rain protection and ventilation. U.S. Pat. No. 3,045,243 discloses a cold-weather garment intended for wear by military personnel. The garment disclosed does appear to provide protection against both rain and cold, and to allow ventilation when rain protection is not needed. However, this garment would not be suitable for wear by a sports vehicle occupant or operator. Such is the case because of the garment's bulk, lack of physical protection features for the wearer, and especially lack of protection against rain being driven through the ventilation openings by the moving air stream encountered by a sports vehicle operator or occupant.

U.S. Pat. No. 4,513,451, issued Apr. 30, 1985; and U.S. Pat. No. 4,722,099, issued Feb. 2, 1988, appear to relate to garments specifically intended for use by motorcycle riders and other sport vehicle operators and occupants. The '451 patent appears to disclose a ventilated suit. Ventilation is provided by opening panels of the suit. This suit appears to provide no protection against foul weather, and would require use of a rain suit also under such conditions. The '099 patent appears to disclose a suit made of real or synthetic leather, and having provisions for supplying a ventilation air flow through the suit which varies with speed. Again, this suit appears to provide no protection against foul weather, and also would require use of a rain suit under such conditions.

SUMMARY OF THE INVENTION

In view of the deficiencies of the related technology, a primary object of this invention is to avoid one or more of these deficiencies.

More particularly, it is an object of this invention to provide a protective garment for wear by operators and occupants of sport vehicle, which will provide physical protection to the wearer, provides adequate and adjustable ventilation for fair and hot days, and also has provision to exclude wind-driven rain and moisture for foul-weather wear.

Another object is to provide such a garment which has provision for the wearer to carry a variety of personal items in stowage areas of the garment.

Still another object is to provide such a garment which has a stowage area separated from ventilation openings such that items stowed in the garment are both protected against loss out of the ventilation openings, and are also protected against dust, road grime, and particulates which may enter the garment via the ventilation opening.

Accordingly, the present invention according to one aspect provides a garment having an outer shell made of water-impermeable material, and having ventilation openings provided on the garment through which ventilation air may pass. These ventilation openings may be secured entirely shut or may be variably opened so that the garment is comfortably worn on cool, fair and hot days. For wear in foul weather, and to exclude both rain water and traffic mist, a water-excluding labyrinth seal structure overlies the ventilation openings. The labyrinth seal structure includes features to gutter or direct water outside of the suit. Consequently, rain water and even wind-driven rain and traffic mist is substantially excluded from passing into the garment through these ventilation openings during such foul-weather wear. The garment also preferably includes features, such as body armor panels and abrasion resistant materials, for improving the physical protection afforded by the garment in the event of a spill from a sport vehicle.

The present invention may be seen to provide a versatile all-weather garment, the garment including a water-proof shell having a front panel and a back panel cooperatively providing a neck opening, and a pair of sleeves one for each of the wearer's arms, a generally vertically extending opening dividing the front panel into two parts and allowing ingress and egress from the garment; the front panel, back panel, and sleeves being formed of a water-proof fabric material; and a slit-like ventilation opening defined in the shell, the ventilation opening having a pair of opposite sides which may gape apart when open to allow ventilation air to pass, closure means defining a closure line lengthwise of the slit-like ventilation opening for selectively opening and closing the ventilation opening, the shell including a pair of water-proof fabric layers one overlying the other and both adjacent to and extending along one side of the slit-like ventilation opening to cooperatively define an elongate pocket, the shell carrying a flexible water-proof flap member adjacent to and extending along the other side of the slit-like ventilation opening, and in a first position the flap member not extending from the other side of the slit-like opening significantly beyond the closure line, in a second position the flap member extending across the closure line and into the pocket to cooperate there with the pair of fabric layers to define a labyrinth seal structure overlying the closure line, whereby in the second position of the flap member the labyrinth seal structure substantially prevents wind-blown water from passing through the ventilation opening.

A better understanding of the present invention will be obtained from reading the following description of a single preferred exemplary embodiment of the present invention when taken in conjunction with the appended drawing Figures, in which the same features (or features analogous in structure or function) are indicated with the same reference numeral throughout the several views. It will be understood that the appended drawing Figures and description here following relate only to one or more exemplary preferred embodiments of the invention, and as such, are not to be taken as implying a limitation on the invention. No such limitation on the invention is implied, and none is to be inferred.

BRIEF DESCRIPTION OF THE DRAWING FIGURES

FIG. 1 provides a fragmentary perspective view of a motorcycle rider wearing a garment in the form of a coat embodying the present invention;

FIGS. 2 and 2*a* respectively provide front and rear elevation views of the garment seen in FIG. 1;

FIGS. 3 and 4 each provide an enlarged fragmentary view of an air vent on an arm of the garment, with FIG. 3 showing features of the garment in a closed fair-weather configuration, and FIG. 4 showing the vent in an open fair-weather configuration;

FIGS. 5 and 6 show cross sectional views through the vent seen in FIGS. 3 and 4, each looking up the arm toward the shoulder, with FIG. 5 showing the vent in the closed fair-weather configuration seen in FIG. 3, and FIG. 6 showing the vent in a closed foul-weather configuration;

FIGS. 7 and 8 provide enlarged fragmentary views of a portion of the front of the garment seen in FIG. 2, with a torso vent and cargo storage system shown in a closed foul-weather configuration in FIG. 7, and in an open and venting fair-weather configuration in FIG. 8;

FIG. 9 provides a cross sectional view taken across the torso vent and cargo storage system opening at the plane indicated by line 9—9 of FIG. 7.

DETAILED DESCRIPTION OF AN EXEMPLARY PREFERRED EMBODIMENT OF THE INVENTION

Figure 7:
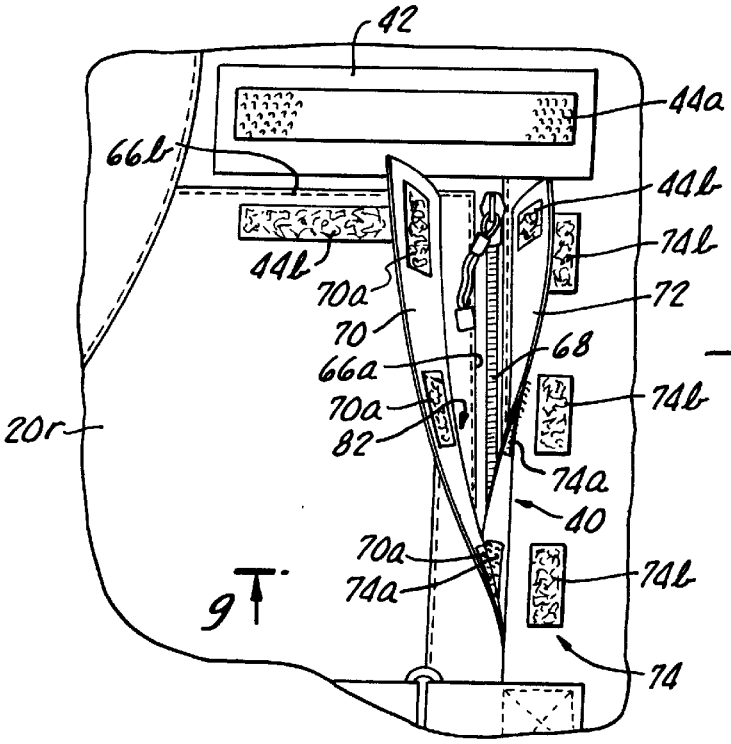

Viewing first FIGS. 1 and 2 in conjunction, a motorcycle rider 10 is seen riding a motorcycle 12. Because of the speed of movement of the motorcycle, the rider 10 is subjected to a moving air stream, indicated on FIG. 1 by arrow 14. The rider 10 is wearing a protective garment 16, which in this case takes the form of a coat or long jacket. It will be understood that the invention is not limited to its use by motorcycle riders, and that other operators and occupants of sports motor vehicles may benefit from the use of this invention. Further, the invention is not limited to embodiment in a jacket or coat, and may find embodiment in a full cover-all type of riding suit, for example. In the case illustrated in FIG. 1, the rider 10 is also wearing protective gloves, boots, and a helmet (not individually referenced in FIG. 1). The rider 10 may be wearing a pair of heavy denim jeans, leather pants, or other protective pants, as will be explained further below. However, it will be noted that because of the fairing or body work on the illustrated motorcycle, the lower part of the rider's body is substantially protected from the air stream 14. This holds true in rainy or traffic mist conditions as well. That is, so long as the motorcycle is moving as some speed the air stream 14 will carry rain and traffic mist past the rider's lower body, and water-proof pants (or the pants of a rain suit, for example) may not be required for the rider's comfort. Alternatively, a rider of an un-faired motorcycle may choose to wear a pair of water or wind proof pants or the pants of a rain suit over ordinary jeans, for example.

As is seen in FIG. 1 however, the rider's upper body is substantially exposed to the air stream 14. Viewing FIG. 1, the posture of the rider's body is of importance. As the rider operates the motorcycle, the arms are generally extended in a forward and downward direction from the shoulders. Further, the rider's upper body or torso may be angulated in a forward direction from the waist. Thus, the rider's shoulders may be further forward into the air stream than is the rider's waist. In order to obtain multi-faceted protection, the rider is wearing coat 16. This coat includes many features in combination providing unique protections for the rider 10. Viewing FIGS. 2 and 2*a* in combination with FIG. 1, it is seen that this coat 16 generally includes an outer shell 18 formed substantially of water-proof fabric material. The shell 18 may be formed of a water-proof fabric material such as GORETEX™ for example. Another possible choice for the material from which the shell 18 may be formed is conventional waxed cotton canvas. Cordura nylon fabric and other nylon fabrics are also available with a waterproof membrane. This membrane may be polyurethane, for example. Other waterproof fabric and fabric-with-membrane materials are readily available in the market. Conventional construction practices including providing a waterproof taping at seams of the jacket will apply also in making the shell 18. It will be understood that many alternative materials of construction for the jacket shell 18 are available and may be utilized, and that the invention is not limited to any particular material of construction for the jacket. For example, a waterproof flexible plastic sheet material (rather than or in combination with a fabric) may be used to make all or a part of the shell 18.

The shell 18 includes a front panel 20 divided into left and right parts (20*l* and 20*r*) by a vertically extending opening 22 providing for the rider 10 to put the coat on and take it off. The coat 16 also includes a back panel 24 (seen in FIG. 2*a*), a left sleeve 26*l*, and a right sleeve 26*r*. The back panel 24 may include a conventional ventilation opening 24*a*. In this case, the ventilation opening 24*a* is provided with a zipper type of slide fastener (not seen in the drawing Figures) for controlling opening and closing of this ventilation opening, and is also provided with a conventional rain flap overlying the zipper and its opening. The front panel 20 and back panel 24 each have respective lower hems 20*b* and 24*b*. Although it is not seen in the drawing Figures, it will be understood that within the shell, the coat 16 may include an insulating liner, or liners. In the case of a coat provided with more than one such liner, the liners are conventionally of differing weights, and the lighter one of these is permanently installed in the coat. A heavier inner liner for use in cold weather is removable from the coat, usually by means of snaps or zipper attachments.

The panels 20 and 24 cooperatively form an opening for the riders neck. In order to provide physical protections to the rider 10, both against the possibilities of abrasion and impact in the event of a spill, and against traffic-thrown pebbles, rocks, other road debris, as well as against impacts with large insects, the coat 16 includes a band collar 28 secured to the panels 20 and 24, closed at 28*a* by a section of hook-and-loop material (i.e., VELCRO™ for example), and defining a neck opening 28*b*. When it is closed, the collar 28 provides protection against pebbles, rocks and insects impacting the rider's throat immediately below the helmet. In order to provide resistance against the coat 16 sliding up the rider's arms or up the rider's torso during a slide following a spill from the moving motorcycle, the sleeves 26 are provided with wrist bands 30 similarly secured with a hook-and-loop type material, or with snaps or other fasteners (not seen in the drawing Figures). The torso is provided with a waist band 32 which may be adjustable or elasticized (or both) helping to keep the coat 16 at the rider's waist. This waist band helps contribute to resistance of the coat 16 against billowing in the air stream 14.

Also, in order to provide protection against abrasion and impacts, the coat 16 is provided at the elbows, shoulders, and back with internal body armor panels, indicated with arrowed numeral 34. At the elbows and shoulders, external abrasion-resistant panels 36 of material such as high denier ballistic nylon fabric, KEVLAR fabric, KEVLAR impregnated plastic sheet material, or leather, for example, are attached to the shell 18. These panels 36 generally overlie the body armor panels 34, and provide in combination both a considerable impact protection, and prevent the coat from being abraded completely through to the skin of the rider in the event of a spill and long slide from high speed.

As is seen in FIG. 1, in dry, mild-weather conditions, the rider will likely wear the coat 16 with no provision being utilized for additional ventilation air flow. In order to provide ventilation and improved comfort for the rider in warm-weather and hot-weather conditions, the coat 16 is provided with slit-like ventilation openings 38, 40 at the sleeves and torso, respectively. In FIGS. 1 and 2, all of the ventilation openings 38 and 40 are shown in their closed, fair-weather configurations. The differing configurations of these vent openings will be more fully illustrated and explained below. As is seen in FIG. 2, the ventilation openings 40 at the torso both extend vertically, and terminate at an upper end under a flap 42. The flap 42 is provided on its underside with one part 44*a* of a hook-and-loop fastener, with the other part 44*b* of this fastener being divided into two parts by the opening 40 for the torso vent. That is, a small portion of the part 44*b* of the hook-and-loop fastener for the flap 42 is carried centrally or toward the opening 22 with respect to ventilation opening 40. This small portion of fastener 44*b* is carried on a weather-sealing flap, to be referenced and described below. The flap 42 is effective to prevent air and water from entering the upper end of opening 40.

Returning to a consideration of FIG. 1, if the rider 10 is riding in foul-weather conditions, with rain or traffic mist being directed at the rider by air stream 14, then the rider will have the ventilation openings 38, 40 in their closed, foul-weather configurations. Importantly, and as will be explained, the ventilation openings 38 and 40 both include a labyrinth sealing feature which prevents the air-driven rain water and traffic mist in air stream 14 from being blown through these openings to the inside of coat 16. Additionally, the vent openings 38 and 40 include a gutter feature which directs water out of the labyrinth seal of the openings 38, 40 downwardly and outwardly of the shell 18. As is seen in FIG. 1, in the riding posture of the rider 10, the ventilation openings 38 and 40 both extend somewhat vertically so that they have a lower end (indicated with the numeral 381 or 401, respectively) from which water may drain from the ventilation openings outside of the coat 16.

Viewing now FIGS. 3–5 in conjunction with one another, one of the ventilation openings 38 is seen in FIGS. 3 and 5 in the closed, dry, fair-weather configuration, and in FIG. 4 in the open, dry, fair-weather configuration. As is seen in FIG. 3, the opening 38 is formed at an interruption of a seam 46 running along the length of the sleeve 26 of the coat 16. At this interruption of the seam 46 for ventilation opening 38, a stitching line 48 along one side of the opening 38 secures several layers of fabric material within shell 18, as will be seen. At the other side of the opening 38, a U-shaped stitching line 50 also secures these layers of fabric material. Except as otherwise noted, the fabric material of these layers is polyurethane coated nylon fabric, Gortex fabric, or other water proof fabric material. A polyurethane coated Cordura nylon fabric material is particularly favored because of its reasonable cost, durability, waterproof nature, and attractive appearance. Generally, the layers of fabric material at the ventilation opening 38 of the shell 18 will be seen to provide an overlying flap 52 and an underlying flap 54 (which is folded back on itself). On its underside, the flap 52 carries a strip of material 56, which is one of the hook-strip or loop-strip of a two-part hook-and-loop fastener. In both of the open and closed dry, fair-weather configurations for the ventilation opening 38, the material 56 is not secured to or securable to a mating strip of hook-and-loop material. This is the case, as will be seen, because the other flap (i.e., underlying flap 54) conceals the mating hook-and-loop fastener material.

Consequently, in the dry-weather configuration of the ventilation opening 38 the rider 10 may freely reach inwardly through opening 38, to open and close a zipper 58 running lengthwise of the opening 38. When the zipper 58 is closed, it defines a closure line 58*a,* and holds the material on each side of opening 38 together, and the overlying flap 52 will generally be atop of underlying flap 54, as is seen in FIG. 5. This position of the flap 52 substantially prevents air stream 14 from entering the opening 38. However, when the rider opens zipper 58, the opening 38 can gap open, as is seen in FIG. 4. The air stream 14 can then enter opening 38 and provide ventilation air flow into the coat 16. The rider 10 can also control the volume of ventilation air entry at opening 38 by positioning the zipper 58 between its fully open and fully closed positions. In order to both prevent the opening 38 from gaping too far open and to also exclude insects and pebbles, for example, from entering via the opening 38, the inner layer of fabric material secured by the stitching lines 48 and 50 is a panel of perforate or foramenous fabric 60. The panel 60 is somewhat slack in the closed position of the opening 38 to allow this opening a controlled gaping when the zipper 58 is opened.

Now, when the rider 10 is in foul-weather conditions, with rain water and traffic mist blowing in air stream 14, it is desirable to not only exclude the air flow but to also prevent water from entering via opening 38. In these conditions, the rider puts the ventilation opening 38 into its foul-weather configuration seen in FIG. 6, with the zipper 58 closed. That is, viewing FIGS. 5 and 6, it is seen that the underlying flap 54 is turned back on itself to form a pocket 54*a* facing the opening 38. The inner portion 54*b* and the outer portion 54*c* of flap 54 are secured to one another by mating strips of hook-and-loop fastener, 62 and 64, respectively. In the fair-weather configuration of this flap, the portions 54*b* and 54*c* are congruent, and the flap 54 extends just to or only slightly beyond the zipper line 58*a*.

Importantly, the fastener 62 on inner portion 54*b* of flap 54 is the mate for fastener 56 on overlying flap 52. As is seen in FIG. 6, the rider 10 separates the two portions 54*b* and 54*c* of flap 54 from one another and pushes the outer portion 54*c* deeper into a pocket 52*a* defined under flap 52 outwardly of zipper 58. In this position, the two portions 54*b* and 54*c* of the flap 54 may be re-secured to one another using the hook-and-loop fastener strips 62, 64, while still defining a pocket 54*a* facing the opening 38. In this configuration, the flap 54 extends significantly beyond the zipper line 58*a* into pocket 52*a*. Further, in this position of the portions 54*b* and 54*c,* a part at least of the fastener strip 62 is exposed, and can mate with the fastener strip 56 on the underside of overlying flap 52. Thus, the rider secures opening 38 shut by engaging fastener strips 56 and 62.

In addition to the above, and as is seen in FIG. 6, in the closed foul-weather configuration of the ventilation opening 38, there is defined a labyrinth seal configuration overlying the zipper 58. That is ,the underlying flap 54 is pushed deeply into the pocket 52*a* formed by flap 52, and forms a flap within a pocket. Importantly, the flap 54 itself forms a pocket 54*a* facing opening 38. As is seen in FIG. 6, water which does enter the opening 38, will be directed into pocket 54*a,* and will not enter the coat past zipper 58. The pocket 54*a* also forms a vertically extending gutter having a closed lower end at 38*l*. From the closed lower end of the gutter in pocket 54*a,* the water may drain from the labyrinth formed at opening 38, but can not enter the coat 16.

Figure 8:
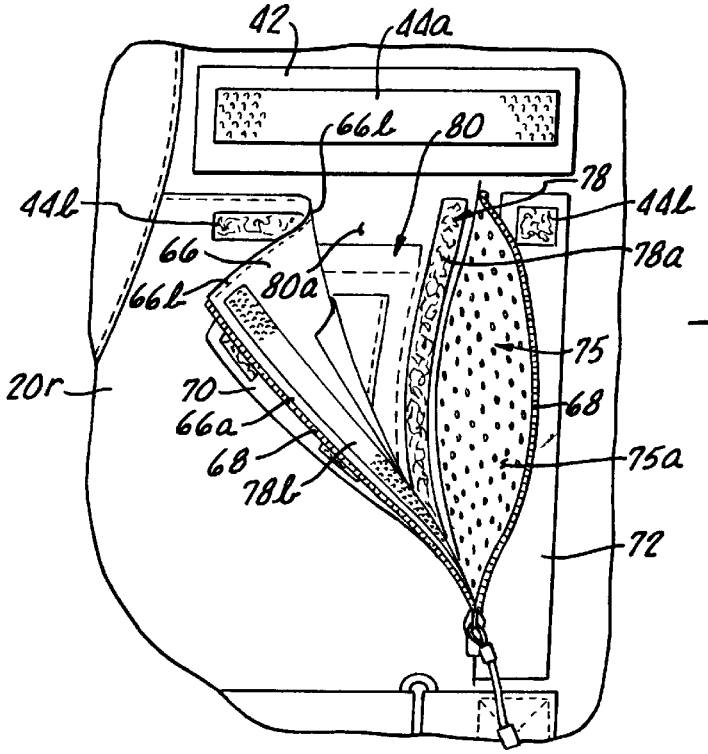
Figure 9:
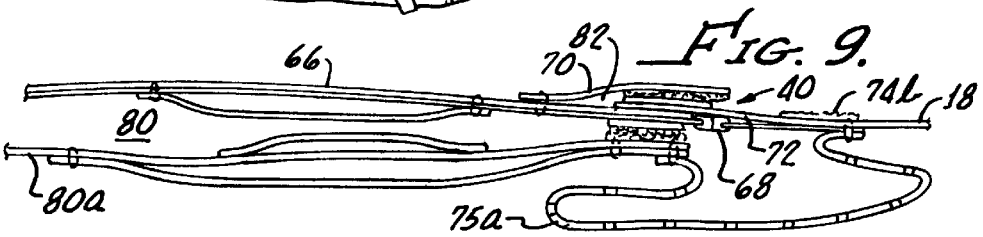

In order to provide similar foul-weather protection to the rider 10 at the torso ventilation openings 40, it is seen in FIGS. 7, 8 and 9, that the torso opening 40 is formed generally by a flap 66 extending across the torso toward opening 40, and having a vertically extending edge 66*a* and free upper edge 66*b*. A vertically extending slide fastener 68 (i.e., in this case a zipper) secures the vertically extending edge 66*a* to the shell 18. Zipper 68 is covered over by a vertically extending flap 70 carried by flap 66 adjacent to the edge 66*a*. Adjacent to the upper edge 66*b,* the flap 66 outwardly carries most of the hook-and-loop fastener portion 44*b* (a small part of this fastener being carried inwardly of the opening 40—as explained above). The small portion of fastener 44*b* is carried outwardly on the upper extent of a weather-seal flap 72. The flap 72 on its under side carries strips 74*a* of hook-and-loop fastener 74, the mating parts 74*b* of which are carried outwardly on the shell 18 adjacent to the opening 22.

In a fair-weather position for the weather-seal flap 72, this flap is secured to the shell 18 by the fastener 74 in the position seen in FIG. 8. This position for the weather-seal flap 72 allow the rider 10 to freely reach and operate zipper 68 because the flap 70 is not secured other than possibly at its top by the flap 42. The zipper 68 may be operated with the flap 42 either in its closed position seen in FIG. 2 on the left side of the coat 16 (i.e., on the viewer's right), or in the open position seen for this flap seen in FIGS. 7 and 8, and which is suggested on the viewer's left side in FIG. 2.

When the zipper 68 is opened (i.e., under dry, fair-weather conditions), as is seen in FIG. 8, a ventilation opening 75 is provided which allows air stream 14 to enter the coat 16 via an underlying perforate fabric panel 75*a*. Like the panel 60 at the ventilation openings 38, panel 75*a* is slack in the closed position for the opening 75, but provides a controlled gaping of this opening when the zipper 68 is opened. Also as seen in FIG. 8, a vertically extending hook-and-loop fastener 78 having one portion 78*a* on the shell 18 outwardly of opening 75, and the other part 78*b* on the inside of flap 66 adjacent to edge 66*a,* prevents the flap 66 from opening when the zipper 68 is opened.

However, as is also seen in FIG. 8, the hook-and-loop fastener 78 may be opened to allow access to a large torso pocket 80, referred to as a Cargo Storage System (CSS). The pocket 80 is defined between the flap 66 and an inner fabric wall 80*a* of the coat 16. At its top, the pocket 80 opens under flap 42. Within the pocket 80 is provided a plurality of additional inner pockets (illustrated in FIG. 8 but not individually referenced). Additional pockets, and features such as a key ring on an elastic lanyard may be provided in the CSS. This pocket 80 is large enough to receive not only small items such as keys and wallets, but also larger soft items, such as gloves, maps, and guide books. Importantly, when the zipper 68 is opened (i.e., creating opening 75), the fastener 78 still provides linearly continuous closure of the vertical side of pocket 80 along the adjacent vertically extending edge 66*a* of flap 66. As a result, not even small items from the contents of this pocket 80 can fall out, even with the vent zippers 68 fully open. Further, this linearly continuous closure of the vertical side of pocket 80 which is provided by fastener 78 adjacent to edge 66*a* prevents the contents of this pocket from being exposed to dust, road dirt, and insects. Such protection is an important consideration for valuable and fragile items.

Returning to consideration of the foul-weather protection provided at the ventilation openings 40, it is seen in FIG. 7 that the two flaps 66 and 70 cooperatively define a recess or shallow vertically extending pocket 82. As is seen in FIG. 2, this pocket or recess 82 is closed at its lower extent by a stitching line 82*a* (i.e., at the lower end 40*l* of vent opening 40—seen in FIG. 2). For foul-weather riding, the flap 72 may be turned by the rider 10 into the recess 82, as is seen at the lower extent of FIG. 7. Again, the rider by turning flap 72 into pocket 82 is forming a "flap within a pocket across an opening" labyrinth seal, and the flap 72 extends significantly across the closure line of zipper 68. On its inside, the flap 70 carries strips 70*a* of hook-and-loop fastener material, which are the mating material for the strips 74*a* on the outwardly exposed side of flap 72 when it is turned into the recess 82. FIG. 9 shows that in this position for the flap 72, the flaps 66, 70, and 72 cooperatively define a labyrinth overlying the zipper 68, and also define a vertically extending gutter directing water downwardly to the outlet at 40*l*. Importantly, the outer flap 70 is now secured in a closed position tightly atop the flap 72. Accordingly, rain water and traffic mist which does enter the opening 40 will be directed down the gutter in pocket 82, will drain out at end 401, and will not reach the rider 10 past zipper 68.

An advantage of the present invention resides in its versatility. An operator, passenger, or occupant of a sports vehicle may wear the garment with comfort in virtually any weather conditions. The wearer is kept warm in cool weather by the air-tight coat shell in combination with the closed vent openings and removable insulated liner(s) which the rider may choose. In mild weather, the shell 18 alone is comfortable, with the ventilation openings shut. In warm and hot, dry weather, the rider can choose the level of cooling ventilation air flow desired. This is effected by partially or fully opening the zippers 58 and 68 controlling the amount of ventilating air flow admitted into the shell 18 via the openings 38 and 40. In rainy weather, the rider changes the air ventilation openings to their foul-weather configuration, and is kept comparatively dry. That is, the coat 18 provides rain protection for the rider's upper body comparable to a rain suit. In many cases, this upper body weather protection is all that is required. In extremely foul-weather conditions, the coat can be worn with rain pants. However, even under these conditions with rider will be more comfortable than with a conventional rain suit because of the fact that between rain squalls, for example, the rider can open the ventilation openings 38 and 40 for improved comfort.

While the present invention has been depicted, described, and is defined by reference to a single particularly preferred embodiment of the invention, such reference does not imply a limitation on the invention, and no such limitation is to be inferred. The invention is capable of considerable modification, alteration, and equivalents in form and function, as will occur to those ordinarily skilled in the pertinent arts. The depicted and described preferred embodiment of the invention is exemplary only, and is not exhaustive of the scope of the invention. Consequently, the invention is intended to be limited only by the spirit and scope of the appended claims, giving full cognizance to equivalents in all respects.

I claim:

1. A versatile all-weather garment, said garment comprising:

a water-proof shell having a front panel and a back panel cooperatively providing a neck opening, and a pair of sleeves, one for each of the wearer's arms, a generally vertically extending opening dividing said front panel into two parts and allowing ingress and egress from said garment;

said front panel, back panel, and sleeves being formed of a water-proof fabric material; and a ventilation opening defined in said shell, said ventilation opening having a pair of opposite sides gaping apart when open to allow ventilation air to pass, closure means defining a closure line lengthwise of said ventilation opening for selectively opening and closing said ventilation opening, said closure means itself not excluding water even when closed, said shell including a pair of water-proof fabric layers one overlying the other and both adjacent to and extending along one side of said ventilation opening to cooperatively define an elongate pocket, said shell carrying a flexible water-proof flap member adjacent to and extending along the other side of said ventilation opening, and in a first position said flap member not extending from said other side of said opening significantly beyond said closure line, in a second position said flap member extending across said closure line and into said pocket to cooperate there with said pair of fabric layers to define a labyrinth seal structure overlying said closure line, whereby in said second position of said flap member said labyrinth seal structure substantially prevents wind-blown water from passing through said ventilation opening.

2. The versatile all-weather garment of claim 1 wherein said flap member in said first position extends toward but not significantly beyond said closure line.

3. The versatile all-weather garment of claim 1 wherein said flap member in said first position extends away from said closure line.

4. The versatile all-weather garment of claim 3 further including a two-part hook-and-loop fastener having a first part carried externally on said shell and a second part carried on said flap member on an underside thereof in said first position, said fastener parts being congruent and intersecuring in said first position of said flap member to secure said flap member removably in said first position.

5. The versatile all-weather garment of claim 4 further including an additional first part of said two-part hook-and-loop fastener which additional part is secured on an underside of an outer one of said pair of water-proof fabric layers in congruence with said second part of said fastener when said flap member is received into said pocket and intersecuring removably with said second part of said fastener on said flap member to secure said flap member in said second position thereof.

6. The versatile all-weather garment of claim 1 wherein said pocket extends generally vertically to provide a water gutter extending toward a lower end of said pocket, and said pair of fabric layers being sealingly secured to one another at said lower end of said pocket, and a water outlet communicating from said lower end of said pocket and water gutter externally of said garment shell to provide water drainage from said labyrinth seal.

7. The versatile all-weather garment of claim 1 wherein said pocket extends generally vertically to provide a water gutter extending toward a lower end of said pocket, and said pair of fabric layers being sealingly secured to one another at said lower end of.

8. The versatile all-weather garment of claim 1 wherein said flap member includes an inner portion and an outer portion connecting to one another by a back fold of said flap member, in said first position of said flap member said first portion and second portion being congruent to one another, and in said second position of said flap member said back fold being received deeply into said pocket beyond said closure line with said inner portion extending across said closure line in cooperation with said pair of fabric layers to form said labyrinth seal structure.

9. An all-weather water-resistant and ventilated coat, said coat comprising: a water-proof shell having a front panel and a back panel cooperatively providing a neck opening, and a pair of sleeves one for each of the wearer's arms; said front panel, back panel, and sleeves being formed of a water-proof fabric material; a generally vertically extending shell opening dividing said front panel into two parts and allowing ingress and egress from said garment; a ventilation structure of said coat including at said front panel:

a flap portion of said front panel extending laterally across from a side thereof generally vertically beneath a respective sleeve and extending toward but short of said shell opening, said flap member having a top edge and a generally vertically extending side edge spaced from said shell opening;

a vertically extending strip portion of said front panel extending laterally between said side edge of said flap portion and said shell opening, said strip portion having a respective vertically extending side edge;

a vertically extending slide closure member securing said side edge of said flap portion to said respective side edge of said strip portion and defining a vertically extending closure line; said slide fastener when open allowing said side edges to gap open at said closure line to provide a vertically extending ventilation opening; and a perforate air-permeable panel spanning said ventilation opening inwardly of said shell to control gaping of said side edges;

a vertically extending sub-flap of water-proof fabric material carried by said flap portion adjacent to said side edge and extending over said slide closure member to both cover said closure line and to cooperate with said flap portion to define a vertically extending pocket, said flap portion and said sub-flap being sealingly secured together at a lower end of said pocket to close said pocket and to communicate said pocket outwardly of said shell; and an additional vertically extending flap member outwardly carried by said strip portion between said respective side edge and said shell opening, said additional flap member in a first position extending toward said shell opening, in a second position said additional flap member extending away from said shell opening and being received into and extending in said pocket across said closure line;

whereby said additional flap member cooperates with said flap member and sub-flap to form a labyrinth seal structure overlying said closure line, and said labyrinth seal structure communicates water entering therein vertically downward to the closed lower end of said pocket and then outwardly of said shell.

10. The all-weather water-resistant and ventilated coat of claim 9 wherein said shell includes an inner fabric wall underlying said flap portion, said inner fabric wall and said flap portion cooperatively forming a torso pocket having an opening at said side edge, a vertically extending and linearly continuous inner closure member disposed inwardly of said pocket with respect to said side edge, said inner closure member when closed closing said pocket at said side edge even though said slide closure member may be open to open said ventilation opening.

11. The all-weather water-resistant and ventilated coat of claim 9 further including a two-part hook-and-loop fastener having a first part carried externally on said shell and a second part carried on said additional flap member on an underside thereof in said first position, said fastener parts being congruent and intersecuring in said first position of said additional flap member to secure said additional flap member removably in said first position.

12. The all-weather water-resistant and ventilated coat of claim 11 further including an additional first part of said two-part hook-and-loop fastener which additional part is secured on an underside of said sub-flap in congruence with said second part of said fastener when said additional flap member is received into said pocket and intersecuring removably with said second part of said fastener on said additional flap member to secure said additional flap member in said second position thereof, whereby said intersecured fastener parts retain said additional flap member in said second position thereof to releasably maintain said labyrinth seal structure at said closure line.

13. A ventilated coat having a torso cargo storage pocket, said coat comprising: a water-proof shell having a front panel and a back panel cooperatively providing a neck opening, and a pair of sleeves one for each of the wearer's arms; a generally vertically extending shell opening dividing said front panel into two parts and allowing ingress and egress from said garment; a ventilation structure of said coat including at said front panel:

a flap portion of said front panel extending laterally across from a side thereof generally vertically beneath a respective sleeve and extending toward but short of said shell opening, said flap member having a top edge and a generally vertically extending side edge spaced from said shell opening;

a vertically extending strip portion of said front panel extending laterally between said side edge of said flap portion and said shell opening, said strip portion having a respective vertically extending side edge;

a vertically extending slide closure member securing said side edge of said flap portion to said respective side edge of said strip portion and defining a vertically extending closure line; said slide fastener when open allowing said side edges to gap open at said closure line to provide a vertically extending ventilation opening; and a perforate air-permeable panel spanning said ventilation opening inwardly of said shell to control gaping of said side edges;

an inner fabric wall underlying said flap portion, said inner fabric wall and said flap portion cooperatively forming a torso cargo storage pocket having an opening at said side edge, a vertically extending and linearly continuous inner closure member disposed inwardly of said pocket with respect to said side edge, said inner closure member when closed closing said pocket at said side edge even though said slide closure member may be open to open said ventilation opening.

14. The ventilated coat having a torso cargo storage pocket of claim 13 wherein said front panel, back panel, and sleeves are all formed of a water-proof fabric material.

15. An all-weather, water-resistant, and ventilated coat having a torso cargo storage pocket, said coat comprising: a water-proof shell having a front panel and a back panel cooperatively providing a neck opening, and a pair of sleeves one for each of the wearer's arms; said front panel, back panel, and sleeves being formed of a water-proof fabric material; a generally vertically extending shell opening dividing said front panel into two parts and allowing ingress and egress from said garment; a ventilation structure of said coat including at said front panel:

a flap portion of said front panel extending laterally across from a side thereof generally vertically beneath a respective sleeve and extending toward but short of said shell opening, said flap member having a top edge and a generally vertically extending side edge spaced from said shell opening;

a vertically extending strip portion of said front panel extending laterally between said side edge of said flap portion and said shell opening, said strip portion having a respective vertically extending side edge;

a vertically extending slide closure member securing said side edge of said flap portion to said respective side edge of said strip portion and defining a vertically extending closure line; said slide fastener when open allowing said side edges to gap open at said closure line to provide a vertically extending ventilation opening;

an inner fabric wall underlying said flap portion, said inner fabric wall and said flap portion cooperatively forming a torso cargo storage pocket having an opening at said side edge, an inner closure member disposed inwardly of said storage pocket with respect to said side edge, said inner closure member when closed substantially closing said storage pocket at said side edge even though said slide closure member may be open to open said ventilation opening:

a perforate air-permeable panel spanning said ventilation opening inwardly of said shell to control gaping of said side edges;

a vertically extending sub-flap of water-proof fabric material carried by said flap portion adjacent to said side edge and extending over said slide closure member to both cover said closure line and to cooperate with said flap portion to define a vertically extending pocket, said flap portion and said sub-flap being sealingly secured together at a lower end of said pocket to close said pocket and to communicate said pocket outwardly of said shell;

an additional vertically extending flap member outwardly carried by said strip portion between said respective side edge and said shell opening, said additional flap member in a first position extending toward said shell opening, in a second position said additional flap member extending away from said shell opening and being received into and extending in said pocket across said closure line;

whereby said additional flap member cooperates with said flap member and sub-flap to form a labyrinth seal structure overlying said closure line, and said labyrinth seal structure communicates water entering therein vertically downward to the closed lower end of said pocket and then outwardly of said shell; and a ventilation opening defined in a sleeve of said shell, said ventilation opening having a pair of opposite sides gaping apart when open to allow ventilation air to pass, a slide closure member defining a closure line lengthwise of said ventilation opening for selectively opening and closing said ventilation opening, said shell including a pair of water-proof fabric layers of said sleeve both adjacent to and extending along one side of said ventilation opening and one overlying the other to cooperatively define an elongate sleeve pocket, said shell carrying a flexible water-proof sleeve flap member on said sleeve adjacent to and extending along the other side of said ventilation opening, in a first position said sleeve flap member extending into said sleeve pocket toward but not significantly across said closure line, in a second position said sleeve flap member extending across said closure line and deeply into said sleeve pocket to cooperate there with said pair of fabric layers to define a labyrinth seal structure overlying said closure line, whereby in said second position of said sleeve flap member said labyrinth seal structure substantially prevents wind-blown water from passing through said ventilation opening on said sleeve.

16. The all-weather, water-resistant, and ventilated coat having a torso cargo storage pocket of claim 15 wherein said sleeve flap member includes an inner portion and an outer portion connecting to one another by a back fold of said sleeve flap member, in said first position of said sleeve flap member said first portion and second portion being congruent to one another, and in said second position of said sleeve flap member said back fold being received deeply into said sleeve pocket beyond said closure line with said inner portion extending across said closure line in cooperation with said pair of fabric layers to form said labyrinth seal structure.

17. The all-weather, water-resistant, and ventilated coat having a torso cargo storage pocket of claim 15 further including said sleeve pocket extending generally vertically to provide a water gutter extending toward a lower end of said ventilation opening between said portions of said sleeve flap, and said pair of fabric layers being sealingly secured to one another at said lower end of said sleeve pocket to provide a water outlet communicating from said lower end of said sleeve pocket externally of said shell to provide water drainage from said labyrinth seal.

18. The all-weather, water-resistant, and ventilated coat having a torso cargo storage pocket of claim 15 further including a perforate air-permeable panel spanning said ventilation opening of said sleeve inwardly of said shell to control gaping of said opening when said slide fastener is open.

* * * * *